United States Patent [19]

Erlich

[11] 4,372,070

[45] Feb. 8, 1983

[54] ADHESIVE SIGN AND METHOD OF MAKING

[76] Inventor: Egon Erlich, 701 Ocean Ave. #10, Santa Monica, Calif. 90402

[21] Appl. No.: 266,913

[22] Filed: May 26, 1981

[51] Int. Cl.[3] ..... G09F 7/16

[52] U.S. Cl. ..... 40/595

[58] Field of Search ..... 40/2, 594, 595

[56] References Cited

U.S. PATENT DOCUMENTS

| | | | |
|---|---|---|---|
| 1,106,340 | 8/1914 | Bellamy | 40/595 |
| 2,591,779 | 4/1952 | Buck | 40/595 |
| 3,461,583 | 8/1969 | Buck | 40/595 |
| 3,541,712 | 11/1970 | Jakeway | 40/595 |

*Primary Examiner*—Gene Mancene
*Assistant Examiner*—Wenceslao J. Contreras
*Attorney, Agent, or Firm*—David O'Reilly

[57] ABSTRACT

An adhesive sign and method of making in which the sign is easily transferred to a receiving surface in one application. The sign is comprised of a material having a predetermined thickness from which characters forming a sign are cut out, leaving the characters in the material. An adhesive is then applied to the top side of the material, excluding the adhesive from the surface areas forming the characters. A second adhesive is then applied to the backside, only on the areas forming the characters. Appropriate covering sheets are then applied to the bottom and tops of the material and the sign is ready for use.

14 Claims, 4 Drawing Figures

ADHESIVE SIGN AND METHOD OF MAKING

BACKGROUND

This invention relates to adhesive-type characters and, more particularly, relates to a plurality of separate adhesive characters forming a sign which may be simultaneously transferred to a receiving surface.

Various type adhesive signs are known in the art. Some of these signs are printed on a material on which an adhesive is placed for applying to a surface. In this case, the sign and the material on which it is placed, is simultaneously secured to the surface. Alternatively, individual letters are provided with an adhesive backing for attachment to a surface to form a sign. However, the difficulty of the latter type adhesive signs is that it is a time-consuming, difficult procedure to form a sign. Various patents have provided for alignment devices for aligning one character adjacent to another, but, in any event, the formation of a sign is a slow, cumbersome procedure. Not only must each letter be aligned horizontally with another, the proper spacing between each letter must be determined before they are fixed to the receiving surface.

One such prior art device is comprised of three layers forming separate characters with alignment tabs formed in the layers. The three layers are formed of the material forming the character and adhesive backing, and a covering material. The individual character is then outlined on the material and cut through the three layers. The backing material covering the area forming the character, is removed and the character applied to a receiving surface. Separate characters are then aligned by utilizing the tabs to form a sign. The non-sign forming material is then stripped away leaving the character properly aligned on the surface. Obviously, such an arrangement is fraught with difficulties in formation of a sign. The backing material secured to the adhesive, however thin, may prevent the character itself from securely adhering to the surface. Thus, when the non-character material is peeled off, the character itself may come with it. Additionally, such an arrangement clearly will present problems with characters having a center area completely surrounded by the outline of the character which must be removed. It would appear that these individual enclosed areas of formed characters would have to be separately removed after formation of a sign. This adds to the time and difficulty in formation of a sign.

SUMMARY

The purposes of the present invention is to provide an adhesive sign in which a plurality of separate raised characters can be simply and easily applied to a surface in one simultaneous application.

The purposes of the present invention are accomplished by forming a sign out of a material in which separate characters making up the sign are formed in the material. The individual characters may be formed by cutting through the material, leaving the characters in the material. Adhesive is then applied to the back side of the characters, excluding all the areas of the material not forming characters. Cover means is provided on top of the material securely laminated to all the areas of the material not forming characters. The sign may now be applied to a receiving surface by pressing the material against the receiving surface until the adhesive on the characters has adhered to the surface. The area of the material not forming the characters may then be stripped away, leaving a sign formed of separate raised characters properly aligned and spaced.

As described above the sign would be for application to a surface immediately after construction of the sign. However, in most cases, the signs will be mass produced and will need a protective backing until they are ready for use. In this case, a covering sheet will be applied to the back side of the material co-extensive with the surface area, lightly adhering to the adhesive on the back side of the characters. Suitable materials or a release coating such as silicone can be provided on the protective backing to prevent attachment of the backing to the characters.

The top covering means is laminated to the material by an adhesive applied to the top side of the material, excluding the area of the characters. The top protective covering is then applied to the top side of the material, co-extensive with the area of the material preferably becoming securely adhered or laminated to the material by the adhesive. Thus, the covering on the top of the material will become laminated to the areas of the material other than the characters forming the sign. In this form, the sign is applied by peeling off the non-adhered protective covering of the back side of the characters, and the sign pressed to a receiving surface. Sufficient rubbing or pressing may be applied to assure attachment of the characters forming this sign to the receiving surface. The top covering sheet, which is laminated to the area outside the characters, is then removed, stripping away the non-sign-forming material, exposing the raised, individual characters forming the sign which remain on the surface by means of the adhesive, thus providing a sign properly aligned and spaced in a permanent position.

As an alternative to simplify use, a split bottom covering sheet may be provided. In this case, two bottom covering sheets, overlapping at approximately the center of the characters, will be provided. In use, one-half of the bottom covering sheet would then be peeled away first and the material forming the sign applied to a receiving surface. The lower half of the bottom protective covering may then be peeled off and the bottom half of the letters pressed against the receiving surface. The placement of the sign is then completed, as was described above.

OBJECTS

It is one object of the present invention to provide an adhesive sign having separate raised characters which can be applied all at once.

Yet another object of the present invention is to provide an adhesive sign comprised of a plurality of separate characters cut from a material and having an adhesive applied only to the back side of the characters forming the sign.

Yet another objective of the present invention is to provide an adhesive sign formed of separate raised characters which eliminates the alignment and spacing problems of prior art adhesive signs.

Other objects, advantages and novel features of the invention will become apparent from the following detailed description when considered in conjunction with the accompanying drawings wherein like reference numbers identify like parts throughout.

DESCRIPTION OF THE PREFERRED EMBODIMENT

Figure 1:
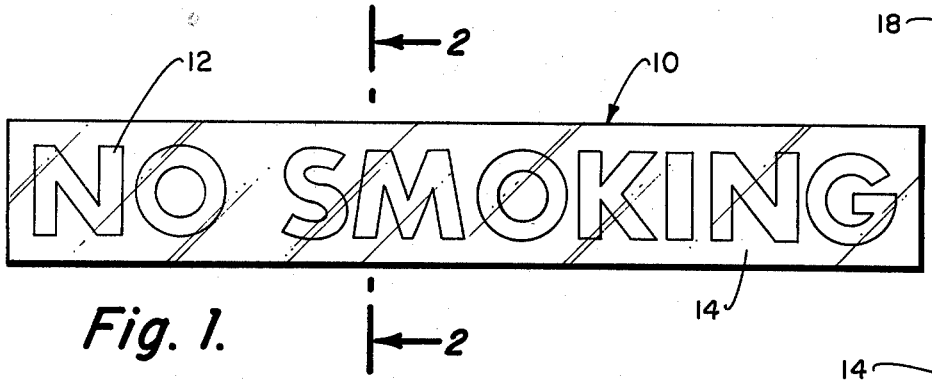
FIG. 1 is a front elevation of a sign constructed according to the method of the invention.

A rectangular sign constructed according to the invention is illustrated generally in FIG. 1. The rectangular shape of the sign is shown for simplicity and ease of illustration. However, a variety of shapes are possible such as round, curved, square, etc. The adhesive sign is constructed so that a plurality of separate independent characters forming a message may be applied to a receiving surface simultaneously and be properly positioned and aligned. The sign is generally indicated at 10 and has a material from which a plurality of individual or separate characters 12 comprising the sign are formed. The sign has a protective covering material 14 on the top which may or may not be transparent.

Figure 2:
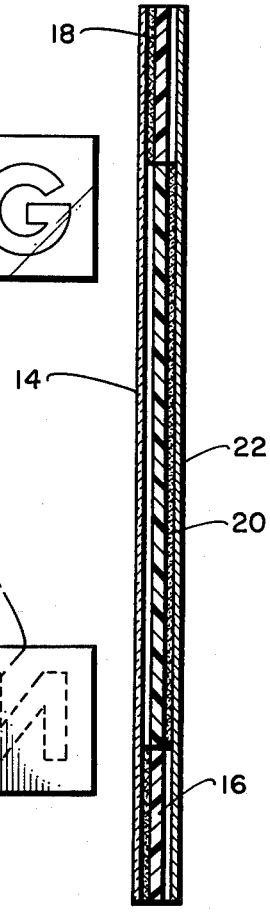
FIG. 2 is a sectional view of the sign constructed according to the invention taken at 2-2 of FIG. 1.

The construction of the sign is shown in greater detail in the sectional view of FIG. 2. The characters forming the sign can be stencilled or outlined on a suitable core material 16, which may be a plastic, rubber, wood or any other material from which individual raised letters of at least one-eighth ($\frac{1}{8}$) inch in thickness, and preferably one-quarter ($\frac{1}{4}$) inch can be formed. The outline of the characters is cut through leaving the characters intact in the sheet of material 16. Alternately, the step of first outlining or stencilling the characters can be eliminated by use of a punch press method. Adhesive 18 is then applied to the surface of the material 16, excluding the area forming the characters 12. A sheet 14, preferably transparent, co-extensive with the surface area of the material 16 is then applied to provide a covering. The top covering is for the purpose of stripping away all the non-character material in one operation when mounting a sign as will be hereinafter described as well as providing protection during handling. Preferably, the transparent material 14 and adhesive 18 are such that the covering becomes securely bonded or laminated to the core material 16 at the areas around the characters forming the sign.

A second coating of adhesive is applied to the back of the material 16 but only in the areas forming the characters or letters themselves. A second covering sheet 22 is applied to the backing of the material to protect the adhesive coating 20. The protective cover 22 on the back is also co-extensive with the area of the sign and may be of any suitable material which will provide protection for the adhesive on the back of the characters. The second protective cover 22 should be of a suitable material which will not securely bond to the adhesive 20 so that it may be easily removed for mounting the sign on a receiving surface. Thus, the bottom covering sheet 22 can be of a plastic or paper or may have a release coating on one side thereof, made of a silicone or other suitable material. The coating on the covering sheet would be such that the protective cover sheet would be readily removable to expose the adhesive.

Figure 3:
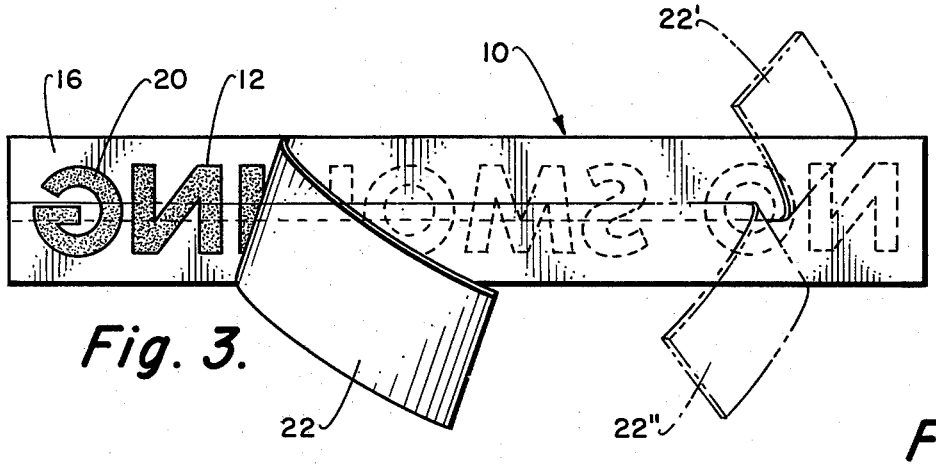
FIG. 3 demonstrates preparation of the sign for application to a receiving surface.

Alternatively, the protective covering sheet 22 may be of two overlapping sheets, as illustrated in phantom in FIG. 3. This should help solve the problem, if it should arise in applying the sign, of the characters having a tendency to stick to the protective sheet 22 making it difficult to peel off and mount the sign. The split covering sheet as illustrated in FIG. 3 would allow the top half 22' to be easily peeled off exposing the upper half of the characters 12. The sign may then be applied to a receiving surface with the adhesive acting to keep the individual characters 12 in place, while the bottom half 22'' is peeled away.

Figure 4:
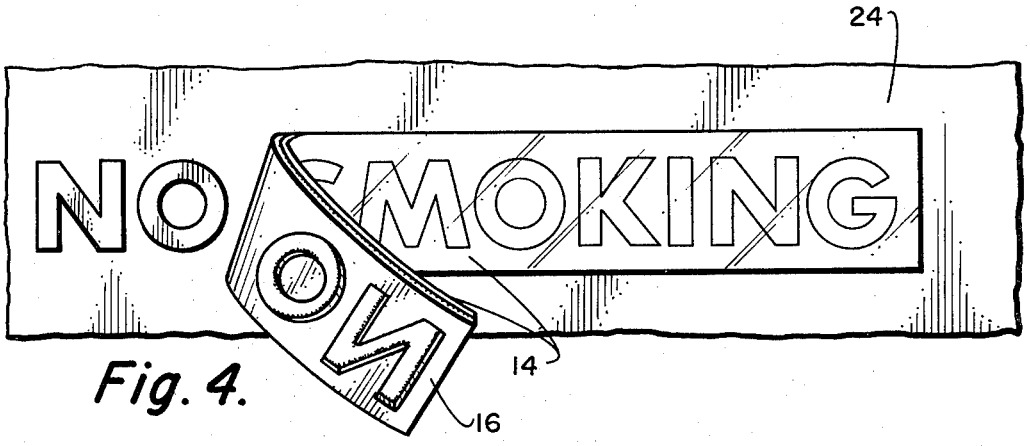
FIG. 4 demonstrates application of the sign to the receiving surface and removal of the matrix.

The installation of the sign on the receiving surface would be performed, as illustrated, in FIGS. 3 and 4. The protective back covering 22 (or the upper half of a split back covering, if used as described hereinabove) would first be removed from the sign 10, exposing the adhesive on the backside of the characters 12. The core material 16, including the characters 12, are then positioned on a smooth receiving surface 24 and pressed firmly against it, making sure that all areas covered with the adhesive 12, bond firmly to the surface. The top covering sheet 14 is then lifted off, carrying with it the non-character core material 16. Because the adhesive 18 applied to the non-character areas of the sheet 16 bonds the material securely to the transparent cover sheet 14, the non-letter area of the material is removed with the covering sheet. Of particular importance with the sign of the present invention is that the non-character areas of such characters as A, 0, 8 etc. will be removed in the same operation. Thus, only the separate raised characters 12 forming the particular message or sign, remain on the receiving surface 24.

Thus, there has been disclosed an adhesive sign and a method of making, in which individual raised letters forming a sign, may be quickly and easily applied to a receiving surface. An advantage of the invention is that a sign formed of individual raised characters may be easily and quickly applied to any receiving surface. The thickness of the raised characters can vary in thickness with $\frac{1}{8}''$ to $\frac{1}{4}''$ being preferred. The adhesive applied to the characters would be selected to be of such strength as to make removal of the letters after application virtually impossible. This is for the purpose of providing weather resistance for signs applied outdoors.

The material 16 forming the characters themselves can be selected from a wide variety and types of materials. Materials such as rubber-based materials, plastic, wood, vinyl, and metals, such as aluminum, would be suitable for the formation of the characters. The covering sheet may be of any suitable material and may extend beyond the edge of the material 16 forming the sign to simplify removal. Alternatives, such as forming the characters to provide a variety of decorative effects, are within the scope of the present invention. For example, the inside of the characters 12 could be depressed to leave an outer rim like a frame if desired. Additionally, the characters could be coated with any variety of colors. Also, to facilitate positioning of the sign during transfer to a receiving surface, a guide mark, such as a short, thin line, may be added at the middle of the sign to indicate the center. A corresponding mark made on the receiving surface may then be used to align with the mark on the sign when it is applied to provide proper positioning. As was also indicated, it is preferable that the top covering be transparent in order to recognize the particular message carried by a sign. The transparent top cover will allow the user to view or recognize the outline of the characters forming the message. The sign disclosed herein is particularly suitable for the often used standard messages such as "NO SMOKING".

Obviously, many modifications and variations of the invention are possible in light of the above teachings; it is therefore to be understood that the full scope of the invention is not limited to the details disclosed herein, but only by the appended claims and may be practiced otherwise than as specifically described.

What is claimed is:

1. An adhesive sign comprising:

a material having a plurality of characters representing a sign cut into the material, said characters remaining in the material;

an adhesive covering substantially the entire top of the material, excluding the areas forming the characters;

a top covering sheet co-extensive with the top surface area of said material;

an adhesive on the bottom of said material; said adhesive material limited only to the areas forming said characters;

a bottom covering sheet means on the bottom of said material coextensive with the surface area of said material.

2. The adhesive sign according to claim 1 in which said material has a predetermined minimum thickness.

3. The adhesive sign according to claim 2 in which said material has a thickness of at least ⅛ inch.

4. The adhesive sign according to claim 1 in which said covering sheets extend beyond the edge of the material to facilitate removal.

5. The adhesive sign according to claim 1 in which said top covering material is transparent whereby the message formed by the characters may be viewed.

6. The adhesive sign according to claim 1 in which said bottom covering sheet means is of a material which has minimum adherence to the adhesive on the back side of the characters.

7. The adhesive sign according to claim 6 in which said bottom covering sheet means has a release coating on the side in contract with the adhesive.

8. The adhesive sign according to claim 7 in which said bottom covering sheet means is comprised of two sheets of material overlapping along approximately the center of said characters.

9. A method of forming a sign having a plurality of separate raised characters comprising:

forming characters representing a message in a material by cutting through the material leaving the characters in the material;

applying an adhesive to only the back side surface area of the characters forming the sign; and providing means on the top area of the material for stripping away all the non-character material simultaneously when mounting the sign.

10. The method according to claim 9 including:

applying a bottom covering sheet to said material co-extensive with the surface area of said material.

11. The method according to claim 10 in which the step of providing means on the top area of the material comprises:

applying an adhesive to the top surface of said material excluding the area of said characters forming said sign;

applying a top covering sheet to said material co-extensive with the surface area of said material.

12. A method of affixing a sign to a surface comprising:

forming characters in a material by cutting through the material, but leaving the characters in the material;

applying an adhesive to the back side area of the characters forming the sign;

positioning the material with the characters forming the sign against a receiving surface;

pressing the material against the receiving surface to be sure the adhesive has adhered to the surface;

stripping the non-character material off the receiving surface leaving the characters forming the sign in place.

13. The method according to claim 12 including providing means for simultaneously stripping all the non-character material away in one operation.

14. The method according to claim 13 in which the step of providing means for simultaneously stripping away the non-character material comprises securely laminating a top cover to the non-character area of the material.

* * * * *